US005947829A

United States Patent [19]

Grimes, Jr.

[11] Patent Number: 5,947,829

[45] Date of Patent: Sep. 7, 1999

[54] METHOD AND APPARATUS FOR SURFING ON ARTIFICIAL SURFACES

[76] Inventor: Martin O. Grimes, Jr., 57 Kay St., Newport, R.I. 02840

[21] Appl. No.: 08/847,561

[22] Filed: Apr. 24, 1997

[51] Int. Cl.[6] ..... A63C 19/10; A63G 21/18

[52] U.S. Cl. ..... 472/90; 472/117

[58] Field of Search ..... 472/88, 89, 90, 472/92, 117, 128

[56] References Cited

U.S. PATENT DOCUMENTS 2,254,482 9/1941 Heller ..... 472/90

4,339,122 7/1982 Croul ..... 472/88

5,011,134 4/1991 Langford ..... 472/117

*Primary Examiner*—Kien T. Nguyen

*Attorney, Agent, or Firm*—Cristina M Offenberg

[57] ABSTRACT

A new sport of skill, SurfSliding having an open pipe ramp system covered in artificial turf and a lubricating means. SurfSliding allows a participant to glide downhill by gravity and kinetic energy while maneuvering a lawnboard strapped to the participants feet. The new sport provides for a sport similar to surfing while executing movements similar to skateboarding and snowboarding.

9 Claims, 6 Drawing Sheets

METHOD AND APPARATUS FOR SURFING ON ARTIFICIAL SURFACES

FIELD OF THE INVENTION

This invention relates to surfing, specifically to "SurfSliding", a new sport of skill which consists of controlled movements on a short "LawnBoard" strapped to the feet of the surfer who glides downhill by gravity and kinetic energy over a slope covered with artificial turf and lubricated by water.

BACKGROUND—DESCRIPTION OF THE PRIOR ART

Surfing on waves and skateboarding on land or ramps have been sporting attractions to many people for quite some time. Snowboarding has [recently] become a very popular winter sport in mountain areas. Water slide parks are abundant in many areas. Such sports attractions are usually confined to geographical locations, i.e. surfing to areas with oceans or lakes with waves. Snowboarding is confined to areas with mountains, snow and cold seasons.

The prior art most comparable to the concept of SurfSliding is the patent of Croul (U.S. Pat. No. 4,339,122). However, the technical and engineering approaches of this reference are not used in the subject invention. The Croul patent discloses an aquatic amusement apparatus comprising "a shaped slope having a plurality of stationary wave-like contours and surface irregularities". The substrate is foam and the covering is vinyl. There are many engineering flaws in the disclosure of this patent, and the subject application employs a different method of designing a SurfSlide apparatus.

Technically speaking, water slides are the closest known type of art. They are usually elongated tubes or troughs following a predetermined circuitous path downward from an elevated starting platform. A typical apparatus of this type is described in U.S. Pat. No. 4,194,733, which was issued to B. Whitehouse, Jr. on Mar. 25, 1980. A slide apparatus which has a generally parabolic upwardly opening cross section is defined in U.S. Pat. No. 5,137,497 issued to David J. Dubeta on Aug. 11, 1992. Another water slide described in U.S. Pat. No. 5,011,134 which was issued to Langford on Apr. 30, 1991 discloses a water slide apparatus which allows for up-hill movement by the inclusion of a drainage tube. This patent introduces a variation of existing water slides, but it still is characterized by "a trough or chute where adequate water is retained to allow the ride to skim the surface". The user is still confined to a narrow predetermined path with little or no control over his speed. Water slides in general need substantial amounts of water, and this particular slide needs to inject and evacuate water from certain points along the trough in order for it to work.

One major difference is that waterslide tubes and troughs are not designed to allow a user to stand erect. Additionally, they are not designed for the user to be an active participant in the ride, only a passive user.

Another prior art reference, M. Heller (U.S. Pat. No. 2,254,482 dated Sep. 2, 1941) discloses an artificial skiing track which was designed to be used without water as the prior art references to this point were unsuccessful in using artificial snow. The Heller patent discloses a means to exercise skiing in the off-season on an artificial track, and it is not the same technique or disclosure for surf-like or snowboard-like exercise in the off-season. Although this reference discloses the use of an artificial sliding surface, it is not similar to the artificial turf used in the subject application as Heller's surface is water resistant rather than water retaining. This is an important difference as skiing is incompatible with a water surface while Surfing and snowboarding use the water for both sliding and control.

All downhill sports utilize the same physical phenomena: 1) that a slope offers downhill force which, under proper conditions, can be translated into downhill motion; 2) that such motion results when the downward force exceeds the friction between the moving body and the substrate and therefore attains a desirable speed, and for this to occur, the friction must be kept low; 3) that the combination of high speed and low friction allows to build up kinetic energy which, in turn, allows the user to move uphill until such energy is expended. These are basics of physics and not patentable phenomena. The patentable differences are represented by the means employed to keep the friction low and constant, the vehicle design, the choice of available path, and the degree in variation of the rides and the attainable levels of skill.

By contrast to the prior art, the SurfSliding ramps employ engineering techniques that are designed for low and constant friction allowing for active motion with a continued pursuit and challenge for increasing the level of skill towards daring acrobatic movement and trickery while standing erect. Additionally, more than one user can be on the ramp system at the same time.

GENERAL DESCRIPTION OF THE INVENTION

The present invention is a SurfSlide which is to provide for a new sport of skill during an extended season. The 'SurfSlide Sport' contains the following elements:

Starting: The Takeoff!

To start a ride, the rider must commit to a given movement. To do so, he must lean forward and into the slope to attain speed. Simultaneously, he must choose a path on which to ride. This is called choosing or picking a line.

First Turn

The rider must lean his body weight to the desired side. This weight transition forces the board's surface to focus on one rail and the center fin. This focused rail becomes the inside rail (the opposing rail is considered the outside rail). Control and movement is achieved by one's command of body position.

Subsequent Turns

A ride is composed of continuous balancing and weight shifting. A turn is the result of weighting and un-weighting while the rider shifts the board position from rail to rail. By using body torque, the rider's footwork controls the board's positioning as it passes over a given surface. This active control of turns makes the ride.

Trickery

The power of gravity, the flow of water, and the skill of riders provide for many exciting maneuvers. LawnBoards have foot straps allowing riders to make many such maneuvers, including aerial acrobatics. The continuous advance of maneuvers will drive the technology of the sport.

The invention facilitates this new sport of downhill surfing on a water lubricated artificial surface suitable for water-oriented themeparks, additions to ski resorts, or stand alone sporting facilities.

The new apparatus is made from commercially available materials, components, and manufacturing processes. The apparatus can be built as an above-ground structure, an in-ground structure, or a combination of the two.

The above-ground apparatus is a ramp system consisting of large open pipes constructed from high strength/low weight materials cradled in a support structure. The interior surfaces of the open pipes are lined with an artificial surface material similar to those used on golf courses. A gutter system on both sides of the pipes along the rims provides a thin sheet of water or other lubricant to continuously run down over the surface material.

In certain soil conditions, in-ground slides offer advantages. The open pipe is scooped out from the soil, and the planking is replaced by material such as gunited concrete or sprayed fiber glass walls. The removed soil can be used for landscaping around the SurfSlides. The water collection channel is inserted at the bottom and covered with the same grating as in the above-ground structure. The gutter system is built into a precast concrete channel and hidden by a concrete cover. The cover also serves as a safety walkway. It is easy to open for service and adjustment of the gutter system. The advantages of the in-ground slides are:

Better fit of the SurfSlides into the landscape, aesthetically more appealing;
Rounded turns instead of discrete angles;
Great flexibility for varying dimensions and shape of open pipe cross sections;
Reduced danger when surfers perform acrobatics above the 'gunwales';
Elimination of weight constraints;
Lower costs in favorable soil conditions.

The lubricant has several functions: 1) it reduces friction for the passing LawnBoard; 2) it acts as a coolant for the LawnBoard; 3) as the water is retained by the material fibers, it acts as a shock absorber when the surfer falls; and 4) the water reduces the risk of friction bums when the surfer falls and slides on the material. Thus, the sheet of water plus the water retained in the fibers of the surface material provide for an ample supply of water for the smooth gliding of the passing LawnBoard, resulting in a hydroplaning experience like that of skim boarding.

At the bottom of the open pipes are gratings of adequate width to allow the water to seep through a portion of perforated surface material and run into a collection channel underneath. Depending on the water availability, the water may either run off in a creek or be recycled by means of a pump/filter system. Each installation requires a site-specific water supply and re-circulation solution using commercially available components. In summary, the invention has the following advantages and objectives a) A new sport similar to surfing and snow boarding;
b) Varying slopes and curves for all skill levels, from beginners to experts;
c) Suitable for large numbers of surfers
d) Enables ski resorts to utilize large portions of their investment (access roads, ski lifts, lodges, stores) in their off-seasons;
e) Can be installed as a stand-alone or as part of a theme park in areas where there are no oceans, lakes, or mountains, thus bringing the surfing experience to new areas.

The subject invention is unique in that it 1) uses artificial turf saturated with water as a low friction surface while any additional water beyond saturation runs off; 2) creates low friction with a water retaining surface which provides a very constant friction for the user; 3) uses the terrain features to define the path thereby simulating a type of path that a snowboarder would choose on a given slope, and allows for a ten to fifteen foot strip on either side to accommodate different speeds; 3) provides for runs with different degrees of difficulty for different skill levels; 4) allows a surfboard to slide in a manner comparable with a snowboard, but which is specifically designed to match with the artificial turf.

DESCRIPTION OF DRAWINGS FIGURES

In the drawings, closely related figures have the same number but different alphabetic suffixes.

1. Elements of the SurfSlide Sport

FIG. 1*a*. shows the SurfSlide trails from beginner to expert slope, all adapted to the natural terrain of a given hill side.

FIG. 1*b*. shows the stand-up version of a lawn board

FIG. 1*c*. shows a cross-sectional support, consisting of two identical side mounts and a center mount.

2. The SurfSlide Apparatus

The support structure, usually made from steel or fiberglass, is so large that it takes several levels of magnification to show its make-up.

FIG. 2*a* shows a side view of the SurfSlide with planking, support structure and slope changes, adapting to the given terrain.

FIG. 2*b* shows details of a concrete footing.

FIG. 2*c* shows light-weight hollow core pultrusions with a removable attachment and artificial turf.

3. Water Supply & Recirculation (No figures, all composed of commercial components)

4. In-Ground SurfSlide

FIG. 3*a* shows the cross section of an in-ground SurfSlide.

FIGS. 3*b* and 3*c* show[s] the water distribution system in two sections:

FIG. 3*b* represents a vertical section through the concrete channel showing water main, control valve, sprinkler head, and coping.

FIG. 3*c* offers a top view of the same arrangement, with the cover removed.

LIST OF REFERENCE NUMERALS

14 Artificial Turf Railing
18 Board
20 Center Section
22 Chair Lifts
24 Clamp
26 Concave Fins
28 Concrete Channel
30 Concrete Footing
36 Control Valve
38 Coping
40 Cover
42 Extension for Fast Turns
44 Flexible Pipe
46 Foot Straps
48 Grating
50 Gunite or Shot-Crete
52 Gutter or Sprinkler
58 Knock-through
60 Lock Strip (Coping)
62 Original Contour
64 Planking (Pultrusions)
68 Railing
70 Removable Attachment
72 Rolled L-Profile, Steel
74 Room for Utility Conduits
76 Safety Walkway
78 Seal

80 Shim Adjustment
82 Side Trellis
84 Slope Decrease
86 Slope Increase
88 Soil, Gravel
90 Steel Shoe
92 Stiffening Steel Sheet
94 Support Plate
96 Surf Slide
98 Surfer, 6 Foot tall, to Scale
104 Trellis Support Structure
106 Water Collection Channel
110 Water Exit Slot (Sprinkler Hd)
112 Water Return Pipe
114 Water Supply Main

DETAILED DESCRIPTION OF DRAWINGS FIGURES

1. Elements of the SurfSlide Sport

FIG. 1*a* renders a complete SurfSlide park with SurfSlides (96) of different slopes for different skill levels. The SurfSlides and the chairlift installations (22) follow the natural terrain to minimize the environmental impact. The use of planking imposes distinct angles instead of curves.

FIG. 1*b* shows the patented Surfin'Turf™ lawn board (U.S.D No. 82,823), a short light weight board (18) with concave fins (26) for directional control and foot straps (46). The special form of this board is protected by a recently granted design patent.

FIG. 1*c*. A typical embodiment of the invention is the open pipe which is constructed of planking (64), supported by a trellis support structure (104) which rests on concrete footings (30). For reason of transport, the pipe support consists of a center section (20) and two side sections (82) which are bolted together. The open pipe can be formed from any material which lends itself to form large cylindrical sections such as sheet metal, planking, or preformed fiberglass sections. In this example, the open pipes are built from hollow core fiberglass pultrusions (64) which offer high strength at low weight and are highly weather resistant; they are easy to transport, to handle and to cut to size on site. Pultrusion planking (64) offers smooth surfaces suitable for adhesive bonding to the rolled steel L-profiles (72) and for the removable attachment of the artificial turf (14) with an adhesive or hook & loop tapes.

The cut-outs in the stiffening steel sheet (92) serve for stress relief. In the center section (20) they provide room for utility conduits (74) such as the water collection channel (106), the water supply main (114), the water return pipes (112) and others. A fast action vertical extension (42) for the outside of turns can be added to the trellis support structure (104). This extension allows for gravity defying maneuvers as well as keeping the riders in the SurfSlide. In all places without such extension, a protruding coping (38) is installed along the upper rim of the SurfSlide to ensure that anyone surfing beyond the upper rim will fall back into the open pipe. Just below the coping (respectively below the extension) is the gutter (52) located to dispense the water or other lubricant. On the bottom, the water escapes through a grating (48) into the water collection channel (106).

To allow for easy service of the artificial turf (14) and for rescue in the event of an accident, a safety walkway (76) is provided on top of the trellis support structure (104), secured by a railing (68).

The relation of a 6 foot tall Surfer (98) and a 30 foot diameter open pipe is sketched to scale.

2. The Aerial SurfSlide

FIG. 2*a*shows a side view of the planked above-ground SurfSlide system (64). The exterior of the open pipe is supported by the trellis structure (104) and mounted on concrete footings (30) with steel shoes (90) comparable to bridge constructions. The slope increases (86) and decreases (84) are mitered between the abutting straight sections.

FIG. 2*b* shows details of a concrete footing (30). The trellis structure (104) rests with a steel shoe (90) on a support plate (94). The space between the two screws has to be calculated to accommodate thermal expansions and contractions. To level out inaccuracies of the footing or to compensate for settlement of the soil, the position of the support plate can be corrected with one or more shim adjustments (80).

FIG. 2*c* illustrates the means of attaching the artificial turf (14) to the inner surface of the SurfSlide. Several commercial turf products are available, mostly manufactured for golf courses, football fields and other sports facilities. The artificial turf (14) shall be selected for good water retention of the fibers. The artificial turf (14) must withstand the full temperature range of the region where it is installed, which often means a range from −25° F. to 120° F. (−32° C. to 52° C.). It must also be highly UV light resistant to avoid embrittlement. The attachment (70) to the planking (64) must be removable to rotate artificial turf (14) sections or to replace worn areas. This can be accomplished with hook & loop strips or with a suitable water resistant, removable sticky adhesive.

3. Water Supply and Recirculation

The water supply system is entirely composed of commercial components such as flexible water pipe, T-connectors, clamps, sprinkler heads, adjustment valves, and so on.

Similarly, the water re-circulation system uses commercial drain grates and sewer pipes for the water collection, as well as pump-filter aggregates to clean and pump the water back up-hill for re-use in the water supply system.

The water system can be adapted to any form and length of the ramps as they are fitted into the natural terrain of the site.

The water supply and re-circulation system is an integral part of the Grimes patent, but the system components which can be purchased from any local plumbing supply house, are not. For this reason the water system is not shown.

4. The In-Ground SurfSlide

FIG. 3*a* shows an in-ground version of the SurfSlide. In this version, the trellis support structure is replaced by the surrounding soil (88), and the planking is replaced by a gunite cement or sprayed fiberglass wall (50). The gutter system (52), the water collection channel (106) with the grating (48) above it, and the artificial turf (14) are all arranged like in the aerial version.

In order to find the soil sufficiently compacted for gunniting, it is best to scoop out the entire depth of the open pipe below the original contour (62) of the terrain. The safety walkway (76) consists in this version of concrete slabs covering the gutter system shown in FIGS. 3*b* and 3*c*.

FIGS. 3*b* and 3*c*, show a section of the gutter system housed in a precast concrete channel (28) for use with an in-ground SurfSlide structure. FIG. 3*b* is a vertical sectional view whereas FIG. 3*c* is a top view of the gutter system. The water main (114) is connected by a flexible pipe (44) to sprinkler heads or water exit slots (110). The dispensed water forms a uniform sheet on the artificial turf (14). The amount of exiting water is controlled by the control valve (36). The lock strips (60) made in bright color from an elastic plastic or rubber, make for a clean looking band which runs along the top of the ramp and also serves as coping.

The feed connection from the water supply main (114) to the sprinkler head (110) goes through a concrete knock-through (58) which, when left intact, protects the utility channel which houses the water main (114) and other utility conduits (not shown) from dirt and water. Around this knock-through (58), the chamber (28) is enlarged to accommodate the damp (24) which attaches the flexible pipes (44) to the sprinkler head (110). To prevent dirt and water from penetrating into the utility channel (not shown), a seal (78) may be installed.

The concrete gutter channel (28) rests on soil or gravel (88) which is level with the upper end of the gunite (50). The channel and the gunite are connected with a tongue-and-groove arrangement to ensure a dean looking rim of the in-ground open pipe. The concrete cover (40) protects the gutter arrangement and serves as a safety walkway at the same time.

Operation of the Invention

1) Construction: Aerial Structure

The SurfSlide Structure

The aerial structure is used in places where an in-ground structure is not possible or practical, such as steep starting ramps, cross-overs, or bridges. To facilitate manufacturing, transport, and assembly, the aerial structure consists of standardized straight and angled sections which are bolted together on-site.

A center section (20)(FIG. 1*c*) is set on the lowest pair of prepared concrete footings (30). The bottom beams are attached to the center section and rest on the second pair of footings. The next center section (20)(FIG.1*c*) is put in place, bolted to the resting beams. A diagonal brace completes the first bottom trellis (not shown). The bottom trellises required for a given run are built first and must be measured carefully to make sure that all levels, angles and distances are correct.

The side sections (82)(FIG. 1*c*) are bolted to both sides of the center sections (20)(FIG. 1*c*) and braced together with straight and diagonal beams to complete the side trellises according to standard steel erection practice.

To complete the structure, end caps for shoeing surfers into the slide and for safe exit at the end must be built to fit the terrain. If extensions for fast turns are used (42)(FIG. 1*c*), sprinklers (not shown) may be installed on the safety walkway (76)(FIG. 1*c*) on the opposite side to shoot a jet of water onto the extension which is located above the gutter (52)(FIG. 1*c*). Also, a "traffic signal system" (not shown) may be installed to avoid one surfer from plowing into another one who has fallen with his board.

The trellis support structure (104)(FIG. 1*c*) must be dimensioned to support the highest load expected. In mountainous areas in the North, this could be 3 feet of wet snow. In the South, high side winds could be the primary concern. Also, the anchoring of the footings must be designed to carry such loads.

Water Supply and Evacuation

Prior to planking, the water collection channel (106)(FIG. 1*c*) is placed in the center section (20)(FIG. 1*c*) and connected to the water return pipe (112)(FIG. 1*c*) in regular intervals. Above the water collection channel (106)(FIG. 1*c*), a grating (48)(FIG. 1*c*) is placed and lined up parallel to the trellis beams. Then, pultrusions or other planks (64)(FIG. 1*c*) are placed on both sides of the grating to plank the open pipe.

Along the "gunwales" of the ramp sprinkler heads or other water dispersion devices are arranged to lubricate the walls from top to bottom. They are connected to the water supply main (114)(FIG. 1*c*) at regular intervals. Other utility pipes are put in place (74)(FIG. 1*c*) and supported as needed with braces attached to the bottom trellises.

Each connection to the water supply main must have a flow control to fine tune the amount of water released similar to the one shown in FIGS. 3*b* and 3*c* for the in-ground structure.—The water supply and the re-circulation system must be designed individually for every installation.

Planking

For the aerial SurfSlide, a trellis support structure (104) (FIG. 1*c*) made from steel with fiberglass pultrusions as planking material has been chosen for the following reasons:

the steel structure for the ease of pre-manufacture, transport and on-site assembly;

the pultrusions for their high strength-to-weight ratio and climatic resilience, their ease of transportation and of cutting them to length in their final position. Both materials offer high strength at reasonable costs.

The pultrusions (64)(FIG. 1*c*) are placed on both sides of the grating (48)(FIG. 1*c*), each pultrusion being oversized in length by 6" to 12" for the final cut. As the pultrusions are put in place, they are glued to the rolled L-profiles (72)(FIG. 1C). The adhesive must withstand the entire temperature range of the geographic area where the SurfSlide is installed; it must be resistant to water and dampness, and it must remain elastic to accommodate differences in thermal expansion between the steel support structure and the fiberglass pultrusion planking.

Lined-up pultrusions (64)(FIG. 1*c*) are cut either straight or mitered for angled turns. To mark the final cutting line, a construction laser can be used. Since even small angular inaccuracies lead to substantial errors in the large dimensions of the SurfSlide, the laser has to be positioned very accurately. The final cut can then be made with a handheld powertool with an abrasive cutting wheel. Thereupon, the pultrusions (64) (FIG. 1*c*) roughly pre-cut for the next section, are laid in place (not glued) so their edges hit the finished pultrusions of the previous section. The laser is then moved a few inches to show a line parallel to the previous cut in order to cut the new pultrusions under the same angle.—Again starting in the center next to the grating (48)(FIG. 1*c*) one thermoplastic pultrusion connector as shown in FIG. 2*c* is inserted between each pair of abutting pultrusions. If the connector is straining to accommodate the angle, it can be warmed up to soften and adopt the angled form while cooling down. At this point, the pultrusions of 'section 2' are also glued to the steel support.

The Turf

The artificial turf (14)(FIG. 2*c*) is installed on the inner surface of the SurfSlide. To facilitate replacement of worn sections, it is recommended to install the artificial turf (14)(FIG. 2*c*) in manageable sizes, referred to as "turf tiles", and to attach them to the pultrusions with either a hook and loop tape as shown in FIG. 2*c* or with a water-resistant, removable adhesive. The requirements for such adhesive are that the turf tiles solidly adhere to the pultrusions, irrespective of temperature and water influence to assure that under no circumstances the edges lift off and a lawn board gets caught underneath a turf tile; on the other hand, the adhesive must be removable for replacement or rotation of turf tiles.

Design Constraints

The rigidity of the pultrusions imposes a rigid design and precision manufacturing of the trellis support structure (104) (FIG. 1*c*) and the concrete footings (30)(FIG. 2*b*) on which the structure rests. To balance out inaccuracies of the concrete footings or to compensate for settlement in the soil, the concrete footings (30)(FIG. 2*b*) provide for shim adjustments (80)(FIG. 2*b*).

2) Construction: In-Ground Structure

In sloped areas with soft, stable ground and without bedrock, the SurfSlide construction can be simplified by scooping out the soil and shaping it into an open pipe, then guniting the shell with "pool building" techniques (FIG. 3*a*).

Prior to guniting, the water collection channel (106)(FIG. 3*a*) made from precast concrete, is inserted in the bottom of the excavated open area. Similarly, the gutters (52)(FIG. 3*a*), water mains (114)(FIGS. 3*b* and 3*c*) and other utility conduits are housed in profiled concrete channels (28)(FIGS. 3*b* and 3*c*) positioned on level soil or gravel (88)(FIGS. 3*b* and 3*c*) on both sides of the open pipe.

The artificial turf (14) is attached as described above. Similarly, all other design features are identical to the aerial structure. In fact, both versions should be combined to take the best advantage of a given terrain.

3) Conclusions, Ramifications and Scope

The reader will see that the SurfSlide invention provides a new SPORT OF SKILL which consists of controlled movements on a lawn board over an open pipe ramp system covered with artificial turf. Such sport is usually not limited by geography, terrain or climate.

While my above description contains many specifities, these should not be construed as limitations on the scope of my invention but rather as an explanation of the preferred embodiments. Many variations of aerial and in-ground SurfSlides are possible. Also, other types of vehicles such as inner tubes, sleds or tobbogans can be used for a ride on the SurfSlide.

SurfSliding is a sport similar to surfing while executing movements similar to skateboarding and snowboarding. SurfSliding can be experienced in various geographical locations and is not confined to the topographical layout of the land. It differs from water slide amusements in that the patron participates actively in the ride. It inspires repeat visits to a facility so the patron can improve his/her skills similar to skiing or snowboarding.

The configuration of this ramp system can reflect a wide variety of designs and layouts for various skill levels of surfers. The arrangement of the ramps is only limited by the imagination of the designer. Depending on the terrain and the desired degree of SurfSlide challenge, different cross-sectional designs may be used, ranging from flat to circular to elliptical or parabolic, lifting or lowering the side walls.

All components of the SurfSlide ramp system and component parts are constructed from commercially available materials. Each project engineer can make changes to use materials available in his area. The open pipes of the invention can be made of straight, hollow fiberglass pultrusions which are easy to transport over the road. Since the open pipe size requirements depend on the customer specifications, the support structure can become very large. If so, it should be designed for pre-manufacture of sections which can be transported on regular trucks (no oversize permits and escorts) and bolted together on-site on prepared concrete pilings.

The basic riding concepts required to SurfSlide are hybrids from skateboarding, skimboarding, surfing and snowboarding which means that the basic movements are well established but now applied in a novel manner. A combination of skill and balance are used to perform maneuvers along a ski slope, an ocean swell, a city street, or now, along a SurfSlide ramp. The primary mechanics of riding are as follows:

Balance

Constant body weight shifting is required to keep on top of and maintain control of a board. In a fluid and dynamic medium, balance is crucial.

Skill

Persistent efforts to ride eventually become learned skills, whereby riders constantly make maneuvers based on given situations. Skilled riders spontaneously change their body dynamics to adapt to surface conditions.

Body

1. Stance Using bent knees, a rider puts one foot forward (steering control) and one foot back (power and balance). The rider and board form an A-frame for stability and control.

2. Torque To turn, a rider uses twisting movements of the body, ultimately controlling the board with the feet. This footwork allows the rider to change directions, using a rail-to-rail transition flow for board and path control.

Grace

Controlled movements allow for the aesthetic flow of turns. This graceful pattern of riding is known as style. Each individual rider develops his or her own personal style.

The fascination of young people with 'boarding' skills leads to competition and offers a sense of accomplishment which attracts repetitive business for the surf slide operator.

Accordingly, the scope of the invention should be determined not by the illustrations provided but by the attached claims and their legal equivalents.

What is claimed is:

1. A surfslide apparatus comprising:

(a) a fixed open pipe ramp system having a top and a bottom and having an inner side and outer side;

(b) a friction control surface with the ability to retain a lubricant disposed on said inner side of said ramp system;

(c) a lubricant which flows over said friction control surface of said inner side of said ramp system;

(d) said ramp system having an upwardly opening cross section substantially wide to enable a user to control speed and movement and sloping downwardly and forwardly from said top to said bottom;

(e) said ramp system having an entrance at said top whereby a user or a conveyance carrying a user enters, travels on said ramp system downwardly over said friction control surface, the users skills are employed to control direction, speed, and vertical ability while traveling downwardly on said ramp system until the user exits said ramp system at said bottom of said ramp system; and (f) a drain system.

2. An apparatus as claimed in claim 1 in which said lubricant controls the friction between said friction control surface and a user or conveyance carrying a user sliding over said friction control surface.

3. An apparatus as claimed in claim 1 which further comprises a means for supporting said ramp system.

4. An apparatus as claimed in claim 1 which further comprises a lubrication recirculation system.

5. An apparatus as claimed in claim 1 which further comprises an attachment means for adhering said friction control surface to the inner side of the said ramp system.

6. An apparatus as claimed in claim 1 which further comprises said ramp system having a plurality of curves and slope increases and decreases as said ramp system is constructed downwardly and forwardly from top to bottom.

7. An apparatus as claimed in claim 1 which further comprises a conveyance carrier on which a user rides allowing the user to travel downwardly through said ramp system either standing erect, sitting, lying, or kneeling on a conveyance carrier.

8. An apparatus as claimed in claim 1 which further comprises a plurality of open pipe structures connected together to form said ramp system.

9. An apparatus as claimed in claim 1 in which said ramp system has a first upper wall disposed on the left of the longitudinal axis of said open pipe and a second upper wall disposed on the right of the longitudinal axis of said open pipe which allows for a user or conveyance carrying a user to stand or sit and travel upwardly upon said first upper wall and downwardly again to the center of the ramp system and then upwardly upon said second upper wall, causing a back and forth motion as the user travels in a generally downwardly motion to the bottom of said ramp system.

* * * * *

US005947829C1

(12) EX PARTE REEXAMINATION CERTIFICATE (9705th)

United States Patent

Grimes, Jr.

(10) Number: US 5,947,829 C1

(45) Certificate Issued: Jun. 13, 2013

(54) METHOD AND APPARATUS FOR SURFING ON ARTIFICIAL SURFACES

(75) Inventor: Martin O. Grimes, Jr., Newport, RI (US)

(73) Assignee: Nicole Hausen, Newport, RI (US)

Reexamination Request:
No. 90/012,416, Aug. 30, 2012

Reexamination Certificate for:

| | |
|---|---|
| Patent No.: | **5,947,829** |
| Issued: | **Sep. 7, 1999** |
| Appl. No.: | **08/847,561** |
| Filed: | **Apr. 24, 1997** |

(51) Int. Cl.
*A63C 19/10* (2006.01)
*A63G 21/18* (2006.01)

(52) U.S. Cl.
USPC ..... 472/90; 472/117

(58) Field of Classification Search
None
See application file for complete search history.

(56) References Cited

To view the complete listing of prior art documents cited during the proceeding for Reexamination Control Number 90/012,416, please refer to the USPTO's public Patent Application Information Retrieval (PAIR) system under the Display References tab.

*Primary Examiner* — Jeffrey R Jastrzab

(57) ABSTRACT

A new sport of skill, SurfSliding having an open pipe ramp system covered in artificial turf and a lubricating means. SurfSliding allows a participant to glide downhill by gravity and kinetic energy while maneuvering a lawnboard strapped to the participants feet. The new sport provides for a sport similar to surfing while executing movements similar to skateboarding and snowboarding.

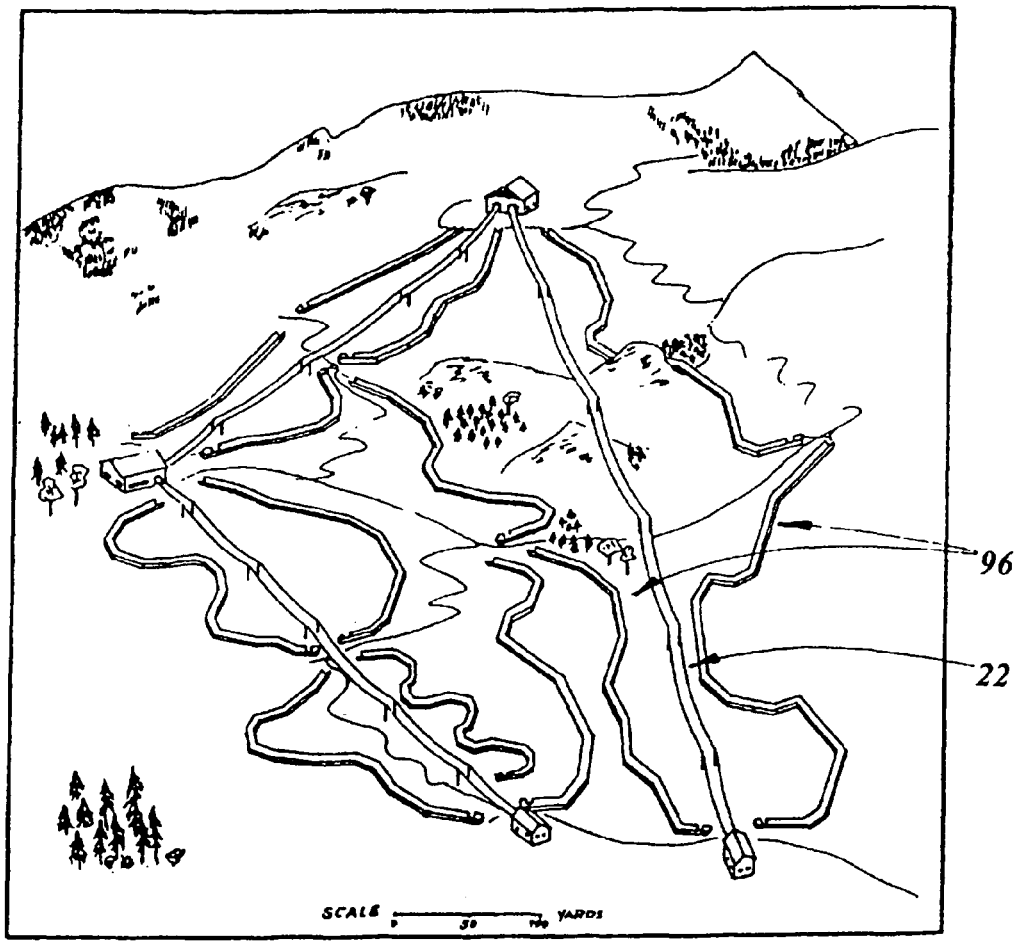

EX PARTE REEXAMINATION CERTIFICATE ISSUED UNDER 35 U.S.C. 307

Figure 1A:
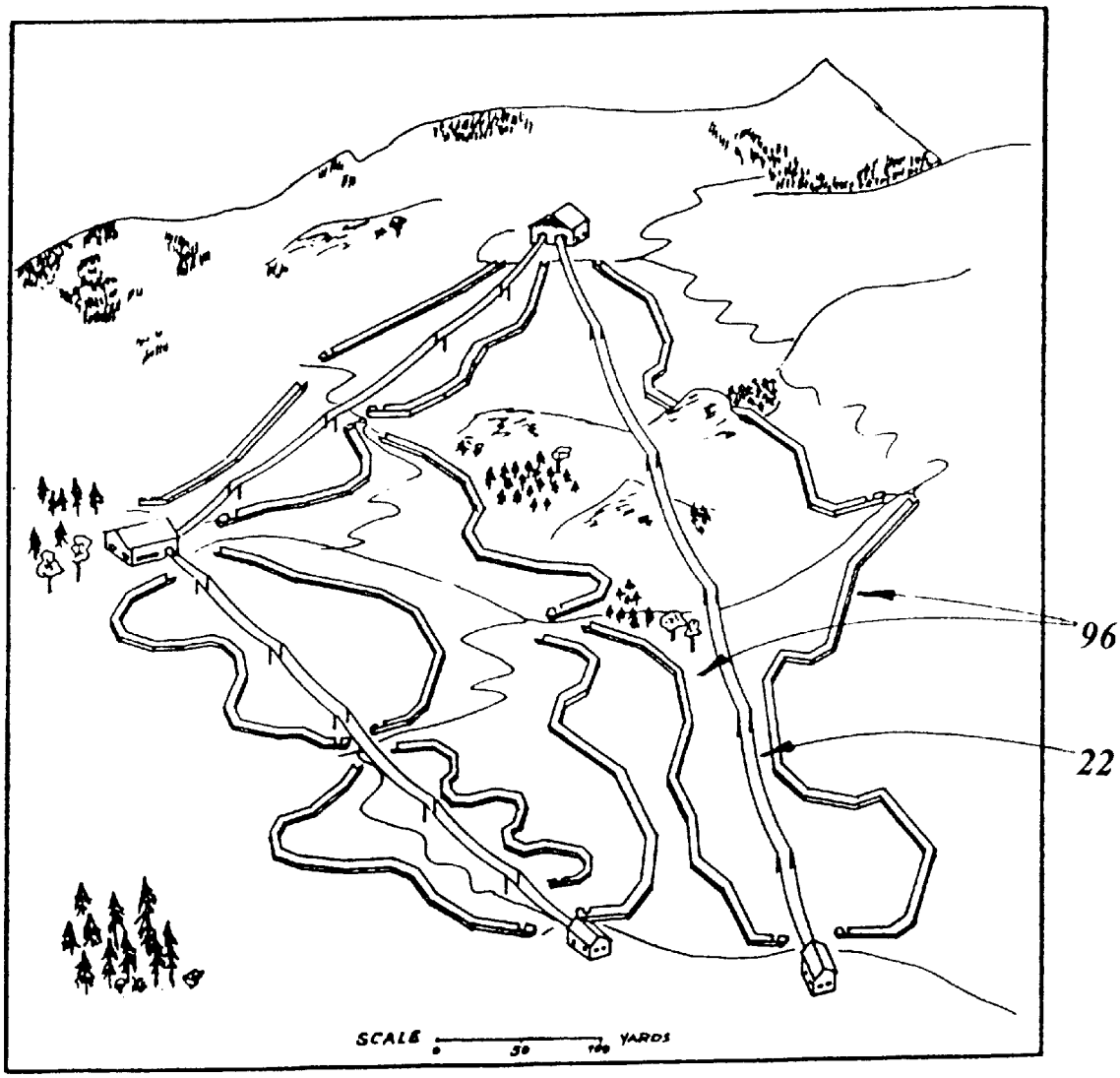
Figure 1B:
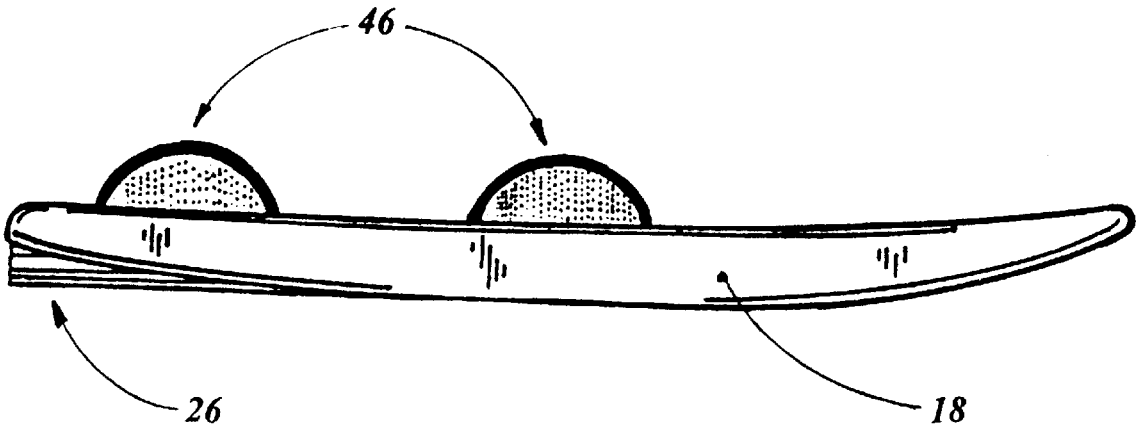
Figure 1C:
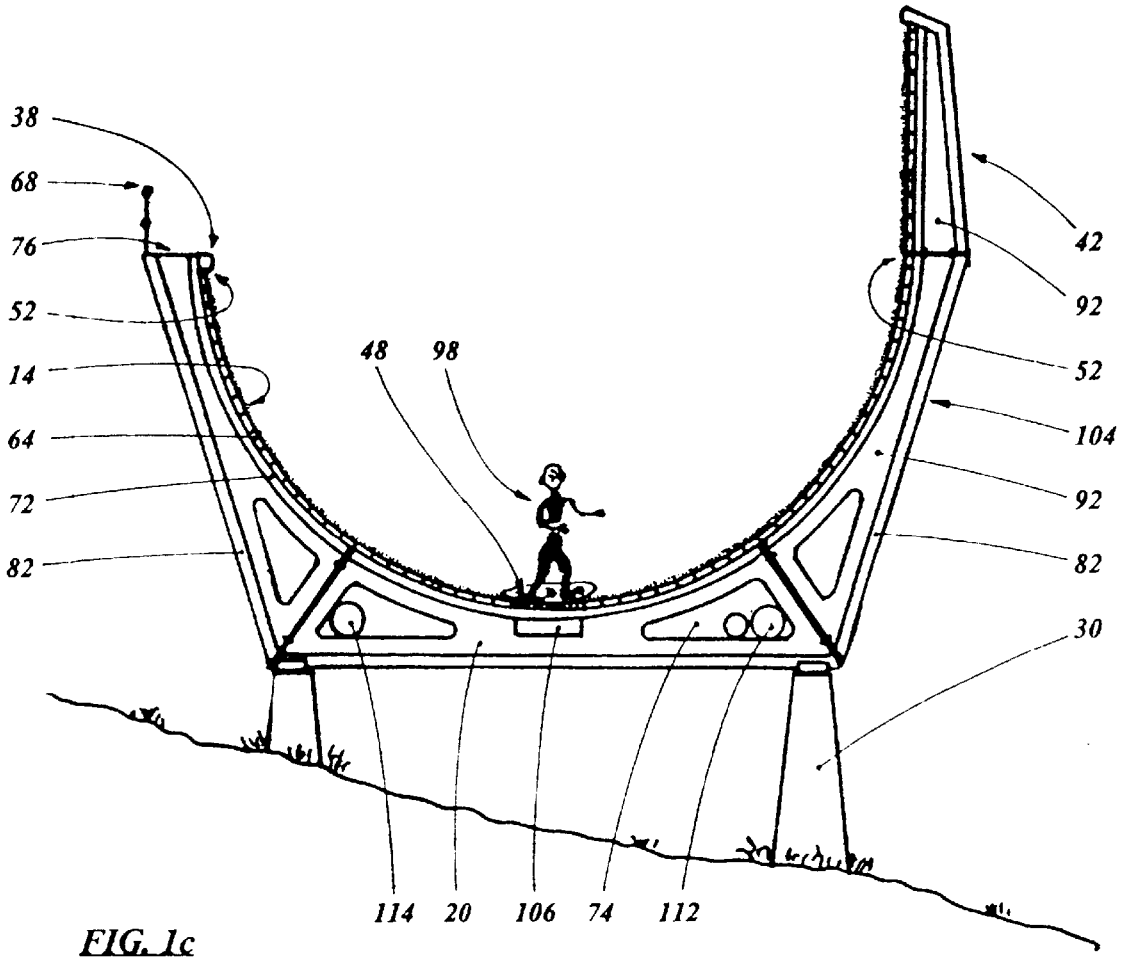
Figures 2A, 2B:
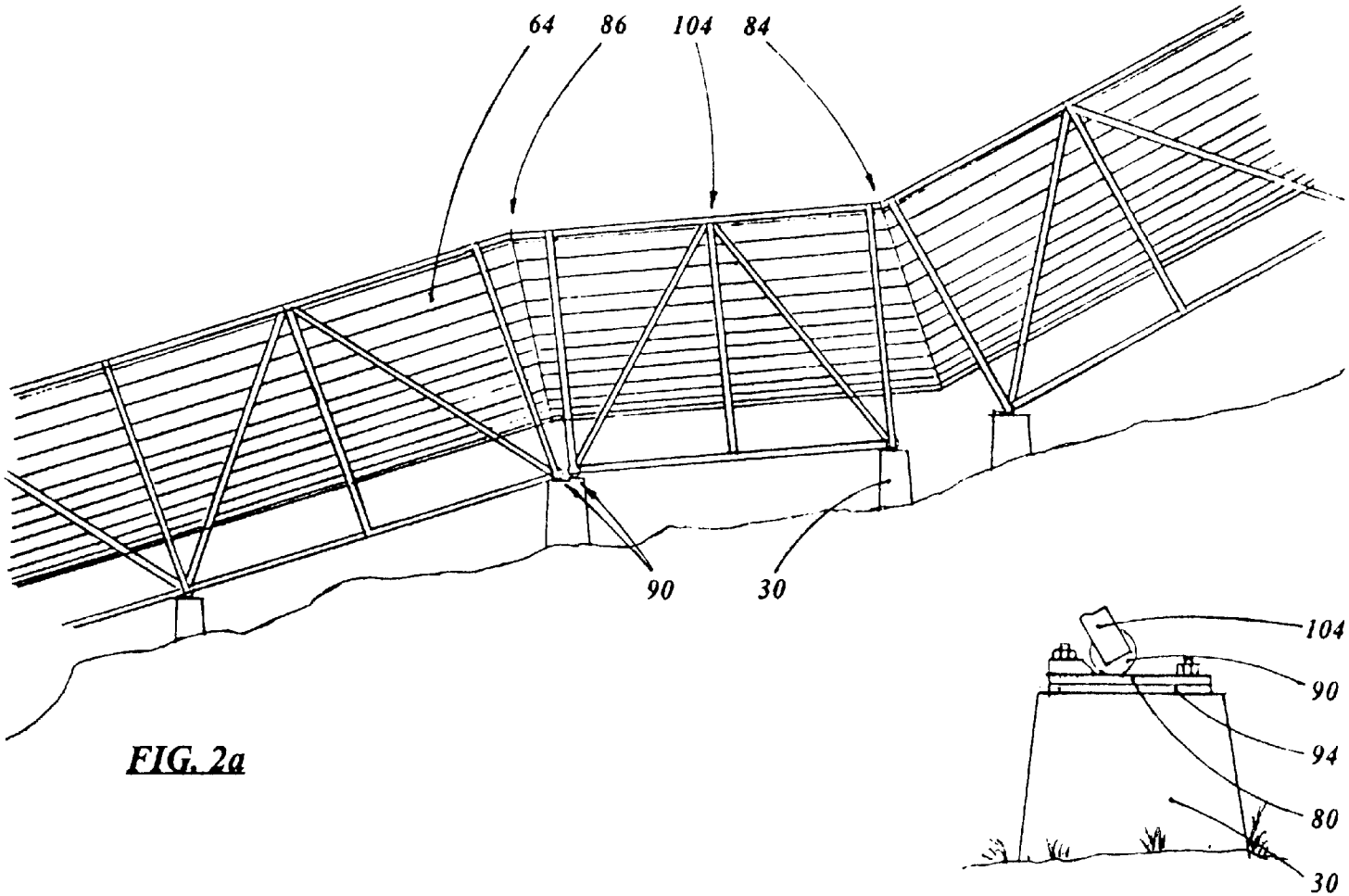
Figure 2C:
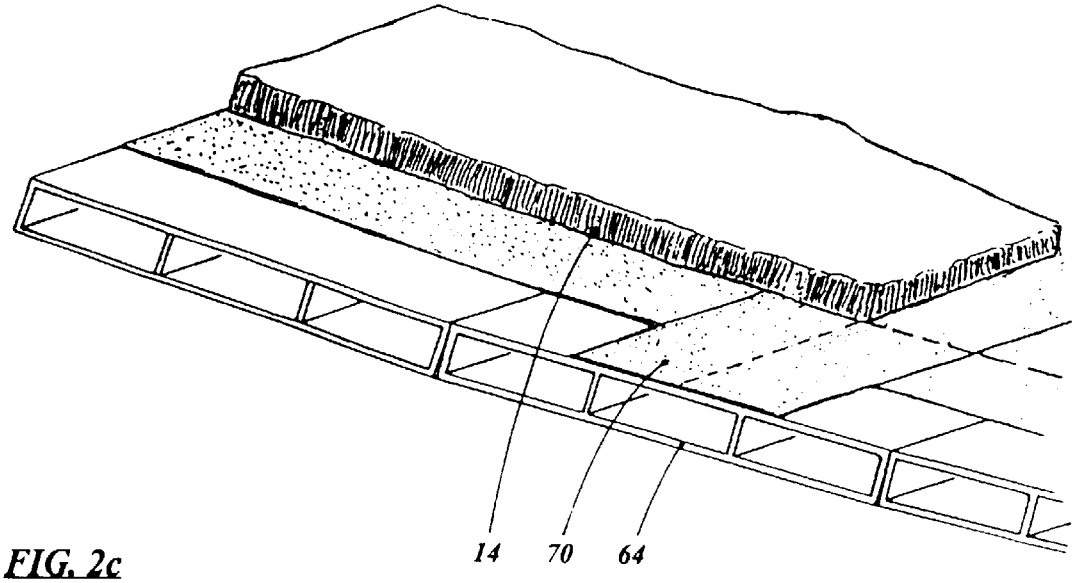
Figure 3A:
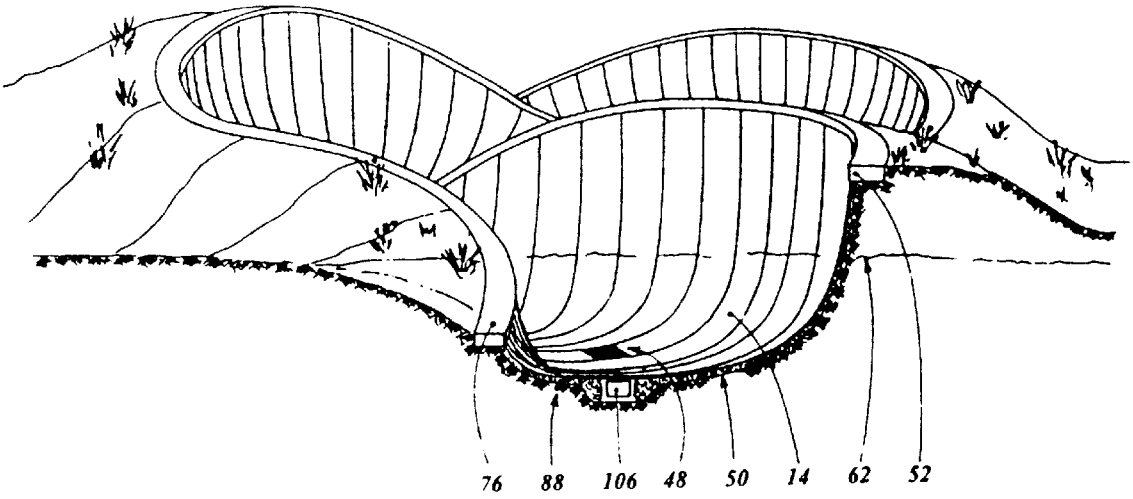
Figure 3B:
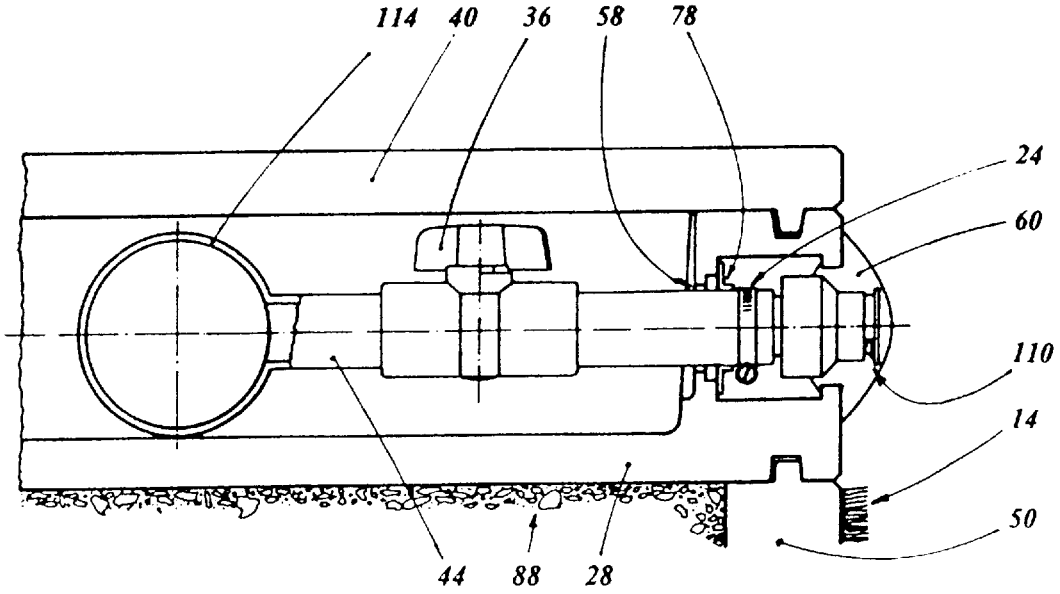
Figure 3C:
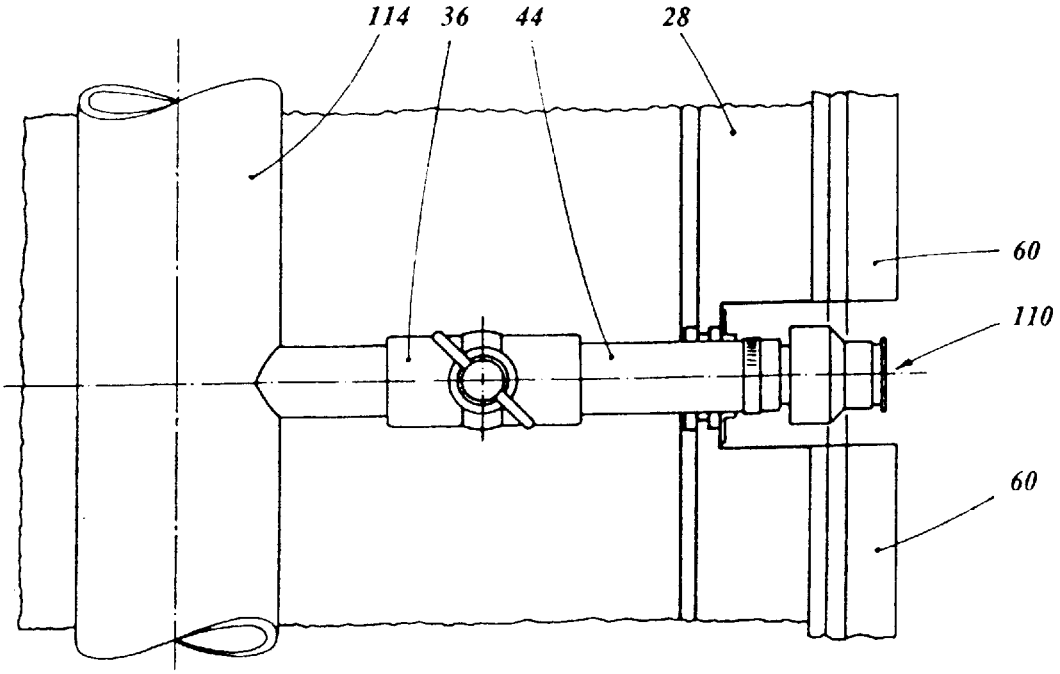

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-9 are determined to be patentable as amended.

New claims 10-15 are added and determined to be patentable.

1. A surfslide [apparatus] *system* comprising:

(a) a fixed open pipe ramp system having a top and a bottom and having an inner side and outer side;

(b) a friction control surface *including fibers* with the ability to retain *and become saturated with* a lubricant disposed on said inner side of said ramp system;

(c) a lubricant which flows over said friction control surface of said inner side of said ramp system *forming a sheet of lubricant on said friction control surface;*

(*d*) *a lawn board including a first rail and a second rail on opposing sides of the lawn board, the sheet of lubricant in combination with the lubricant retained in the friction control surface such that a user surfsliding downwardly over said friction control system using the lawn board controls movement by transitioning weight so as to focus on one of the first and second rails*;

([d]*e*) said ramp system having an upwardly opening cross section substantially wide to enable [a] *the* user to control speed and movement and sloping downwardly and forwardly from said top to said bottom;

([e]*f*) said ramp system having an entrance at said top whereby [a] *the* user or [a conveyance] *the lawn board* carrying [a] *the* user enters, travels on said ramp system downwardly over said friction control surface, the users skills are employed to control direction, speed, and vertical ability while traveling downwardly on said ramp system until the user exits said ramp system at said bottom of said ramp system; and ([f]*g*) a drain system.

2. [An apparatus] *A system* as claimed in claim 1 in which said lubricant controls the friction between said friction control surface and [a user or conveyance] *the lawn board* carrying [a] *the* user sliding over said friction control surface.

3. [An apparatus] *A system* as claimed in claim 1 which further comprises a means for supporting said ramp system.

4. [An apparatus] *A system* as claimed in claim 1 which further comprises a lubrication recirculation system.

5. [An apparatus] *A system* as claimed in claim 1 which further comprises an attachment means for adhering said friction control surface to the inner side of the said ramp system.

6. [An apparatus] *A system* as claimed in claim 1 which further comprises said ramp system having a plurality of curves and slope increases and decreases as said ramp system is constructed downwardly and forwardly from top to bottom.

7. [An apparatus] *A system* as claimed in claim 1 wherein the [which further comprises a conveyance carrier] *lawn board* on which [a] *the* user rides [allowing] *allows* the user to travel downwardly through said ramp system either standing erect, sitting, lying, or kneeling on [a conveyance carrier] *the lawn board*.

8. [An apparatus] *A system* as claimed in claim 1 which further comprises a plurality of open pipe structures connected together to form said ramp system.

9. [An apparatus] *A system* as claimed in claim 1 in which said ramp system has a first upper wall disposed on the left of the longitudinal axis of said open pipe and a second upper wall disposed on the right of the longitudinal axis of said open pipe which allows for [a] *the* user [or conveyance carrying a user] *surfsliding using the lawn board* to stand or sit and travel upwardly upon said first upper wall and downwardly again to the center of the ramp system and then upwardly upon said second upper wall, causing a back and forth motion as the user travels in a generally downwardly motion to the bottom of said ramp system.

*10. A system according to claim 1, wherein the sheet of lubricant in combination with the lubricant retained in the friction control surface allows a hydroplaning effect when using the lawn board.*

*11. A system according to claim 1, further comprising a lubricant supply system configured to supply the lubricant.*

*12. A system according to claim 11, wherein the lubricant supply system includes a gutter system configured to supply the lubricant.*

*13. A system according to claim 11, wherein the lubricant supply system is configured to supply a uniform sheet of lubricant on said friction control surface that continuously runs down over said friction control surface.*

*14. A system according to claim 1, wherein the pipe ramp system includes at least one rounded turn moving downwardly and forwardly.*

*15. A system according to claim 14, wherein the pipe ramp system includes S-turns.*

* * * * *